United States Patent [19]

Gasparaitis et al.

[11] 4,435,713

[45] Mar. 6, 1984

[54] WHIP ANTENNA CONSTRUCTION

[75] Inventors: Bernard Gasparaitis, Tamarac; Thomas W. Long, Jr.; Charles P. Richardson, both of Coral Springs, all of Fla.

[73] Assignee: Motorola, Inc., Schaumburg, Ill.

[21] Appl. No.: 323,220

[22] Filed: Nov. 20, 1981

[51] Int. Cl.[3] ..... H01Q 1/36

[52] U.S. Cl. ..... 343/702; 343/895; 343/873

[58] Field of Search ..... 343/702, 872, 873, 895, 343/900

[56] References Cited

U.S. PATENT DOCUMENTS

| | | | |
|---|---|---|---|
| 3,102,268 | 8/1963 | Foley | 343/895 |
| 3,287,732 | 11/1966 | Altmayer | 343/895 |
| 3,781,899 | 12/1973 | Lockwood | 343/895 |
| 3,789,418 | 1/1974 | Reiber et al. | 343/872 |
| 4,379,298 | 4/1983 | Vincent et al. | 343/895 |

*Primary Examiner*—Eli Lieberman
*Assistant Examiner*—Michael C. Wimer
*Attorney, Agent, or Firm*—Joan Pennington; Edward M. Roney; James W. Gillman

[57] ABSTRACT

A whip antenna assembly of conductive cable, conductive base section, conductive protection knob and a environmental cover. The conductive antenna cable is constructed of multiple layers of brass plated stainless steel wire wound in a helix about a single wire strand which serves as a central core. The conductive base section and conductive protection knob consist of a zinc alloy and are injection cast onto opposite ends of the conductive antenna cable. An environmental cover made from polyurethane is injection molded over the subassembly of conductive antenna cable, conductive base section and conductive protection knob.

4 Claims, 3 Drawing Figures

WHIP ANTENNA CONSTRUCTION

BACKGROUND OF THE INVENTION

1. Field of the Invention

This invention relates to electromagnetic antenna construction and the process for fabricating the same. More particularly the invention relates to whip antenna construction with a protective coating for use with two-way portable communication equipment.

2. Prior Art

In certain types of whip antennas the conducting antenna wire is carried on a highly flexible core usually in spiral conformations. In order to give the antenna a reasonable useable life it is desirable that the core and the wire be covered to protect the assembly from the effects of weather, abrasion, and physical blows to which a whip antenna is subjected during normal use. A protective antenna cover prevents alteration in the electrical characteristics of the antenna which might result in degraded antenna performance. It is of course necessary that the covering provided be flexible so as to not impair the flexibility of the antenna.

In the prior art an antenna cable is normally constructed by spiraling conductive wire along the core length of a flexible core. A base section for the antenna is machined from stainless steel or brass. One end of the antenna cable is then press fitted into a bore at one end of the stainless steel base section. At an opposite end of the base section threads are provided so that the antenna may be mounted to the radio housing. The machined stainless steel base section conducts the RF signal between the antenna cable and the radio receiver. The antenna wire wound about its flexible core and press fitted into the base section is dipped into a vat of liquid plastic and then removed to cure. The resulting coat of plastic serves as a protective cover for the whip antenna. This protective cover protects the antenna cable and base section and yet will flex so that the flexibility of the antenna cable is not impaired.

A soft plastic cap piece is glued over the free end of the plastic coated antenna in order to provide protection to the user against the otherwise blunt end of the antenna cable. The cap piece also protects the antenna cable end from the abuses of its normal environment. Often, in the process of daily use, the cap piece will loosen and fall off the antenna cable end. If this happens the antenna cable end is left exposed to the weather and physical effects of its normal use which results in degradation of the antennas electrical performance.

When in use often the radio is carried in a belt holster around the user's waist. If the portable radio has rechargeable batteries it is most likely recharged in a device which cradles the radio housing. In both of these holding arrangements users have found it convenient to remove the two-way radio from its holder by improperly using the antenna as a handle. The protective cover construction of the prior art does not provide sufficient protection for the antenna when it is subjected to this type of use. From such use, the antenna cap piece may be forced off and the plastic coating is subject to sliding along the antenna length exposing the base portion of the antenna to the environment. Moreover without an antenna cap piece the exposed antenna cable end could cause physical harm to the user since the portable radio is held close to the face during normal operation. Such disintegration of the antennas protective coating usually results in degradation or grounding of the antenna through corrosion, collection of dirt and other deterioration resulting from exposure to the environment.

Since the antenna comprises the simplest technical construction in a two-way radio, the fact that it is subject to heavy physical abuse by the user has in the past been a problem not sufficiently appreciated. In many applications this has resulted in an antenna life span of only a few months.

It is therefore an object of this invention to provide a simple, yet rugged, whip antenna construction which protects and improves antenna electrical performance.

It is a further object of the present invention to provide a simple and inexpensive to manufacture whip antenna which is of a rugged construction which can simultaneously withstand the abuse of being misused as a handle.

SUMMARY OF THE INVENTION

Briefly the invention is directed to an inexpensive construction for a whip antenna and its environmental protective covering. The antenna cable is formed of multiple layers of helix wound conductive wire. A conductive base section and a conductive protective end sphere are securely attached by being injection cast on the antenna cable at opposite ends of the cable length. A polyurethene insulating material is injection molded over the antenna assembly providing the antenna with electrical insulation and physical protection from the environment thereby maintaining the integrity of the antenna construction for a longer period of time. Such an antenna construction provides improved protection from weather, accidental bending and the pulling force resulting from the antenna's misuse as a handle while simultaneously maintaining sufficient flexibility for normal operation. In addition the antenna construction is simple and inexpensive to manufacture.

DESCRIPTION OF THE PREFERRED EMBODIMENT

Figure 1:
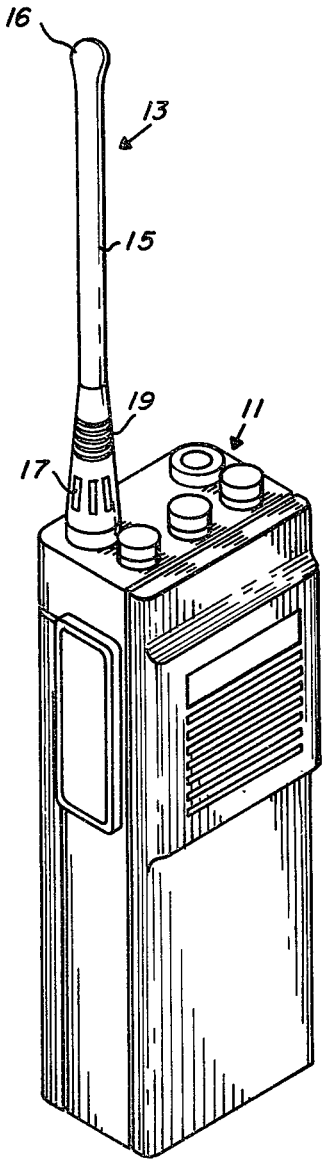
FIG. 1 is a perspective view of a two-way portable radio with an antenna according to the invention.

FIG. 1 shows a two-way portable radio 11 with an antenna 13 according to the invention. The radio 11 is essentially box shaped. It is hand held by gripping the radio in the palm of the hand. The antenna assembly 13 has a molded environmental cover 15 which protects the antenna from harmful effects of the environment. The top portion 16 of the environmental cover 15 is rounded so as to provide some measure of protection to the user from possible injury since in a normal operation the portable radio is brought into close contact with the face. At the base of the molded environmental cover 15 in FIG. 1 there are finger grip flutes 17 and strain relief grooves 19. The flutes 17 assist the user in mounting and unmounting the antenna from the radio housing. The strain relief grooves 19 assist the antenna molded environmental cover 15 to more easily bend in the antenna bottom region where the molded environmental cover 15 is relatively thicker. Also the strain relief grooves 19 act as a surface grip when the antenna 13 is misused as a handle.

Figure 2:
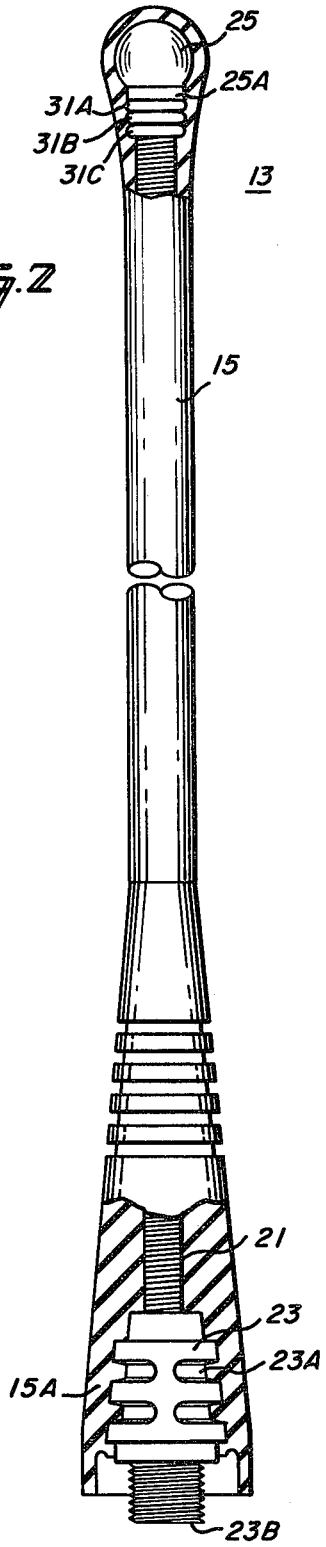
FIG. 2 is a cross section of the antenna and its protective cover according to the invention.

FIG. 2 shows a cross section of the antenna 13 according to the invention. Antenna cable 21 is formed of high tensile strength steel wire or stainless steel with brass plating. In forming the antenna cable, a single wire strand is used as a core. Successive layers are helically wrapped about this single strand with each layer wrapped in the direction opposite that of the previous layer. This cable forming process is similar to the manufacturing process for flexible speedometer cable. For an antenna application the wire is brass or silver plated to enhance its conductivity at RF frequencies. The result is an antenna cable 21 having high flexibility capable of sustaining high torsional forces imposed on antenna cable 21 in its daily use.

Base section 23 is made by injection casting a zinc alloy composition onto one end of the antenna cable 21 length. In addition to its compatibility with the injection casting process the zinc alloy composition offers superior conductivity compared to the prior art stainless steel composition for a base section. Also, and just as importantly, the use of injection casting to form a zinc alloy base section is significantly less expensive than forming a base section by the prior art machining process. The zinc alloy base section 23 serves as a means to both physically and electrically attach the antenna cable to the antenna receptacle mounted on the portable radio. The base section 23 is firmly secured to the antenna cable 21 since injection casting actually molds the base section 23 around one end of the antenna cable 21. The base section includes several annular detents 23*a*, and a threaded portion 23*b* which mates with the radio housing. The threaded portion 23*b* of base section 23 is secured in a receptacle that is part of the portable radio housing.

Protection knob 25 is made by injection casting a zinc alloy composition onto the second end of the antenna cable length. The circular shape of the protection knob 25 provides a smooth curved surface for the antenna end. Such a surface makes it less likely the antenna will snag on clothing or other objects in its normal use. The protection knob 25 also serves to disperse static electrical charges at the antenna cable end. Recognizing that it is common for portable radio users to misuse the antenna, protection knob 25 also facilitates ease in the use of the antenna assembly as a handle in that the protection knob 25 location at the end of the antenna 13 length makes it less likely the antenna will slip through the grip of the user. In use, annular grooves 23*a* of base section 23 and protection knob 25 help environmental cover 15 maintain its position along the antenna length when it is subjected to external forces. Antenna cable 21, base section 23 and protection knob 25 define an antenna subassembly.

Over this antenna subassembly environmental cover 15 is injection molded. The environmental cover 15 functions primarily to protect and insulate the antenna subassembly of antenna cable 21, zinc alloy base section 23 and zinc alloy protection knob 25 from possible damage. Also the environmental cover 15 materially helps to prevent high frequency burns and possible electrical grounding. But it also adds strength to the subassembly by providing a coating of material which, while flexible, provides a source of resistance to antenna deformation. The environmental cover 15 includes a skirt portion 15*a*, shown in FIG. 2, which flares out over base section 23. The skirts 15*a* extends partly along the length of threaded part 23*b* so that when the antenna assembly is secured into the antenna receptacle of a portable radio housing, the bottom of skirt 15*a* acts as a gasket which seals the antenna from the outside environment. It also acts to hold the antenna in engagement with the portable radio housing by creating a frictional surface between the bottom of the skirt 15*a* and the top surface of the housing. As shown in FIG. 1 the skirt 15*a* can include finger grip flutes on its surface for use as a grip to assist the user in attaching or detaching the antenna to the portable radio housing receptacle.

Figure 3:
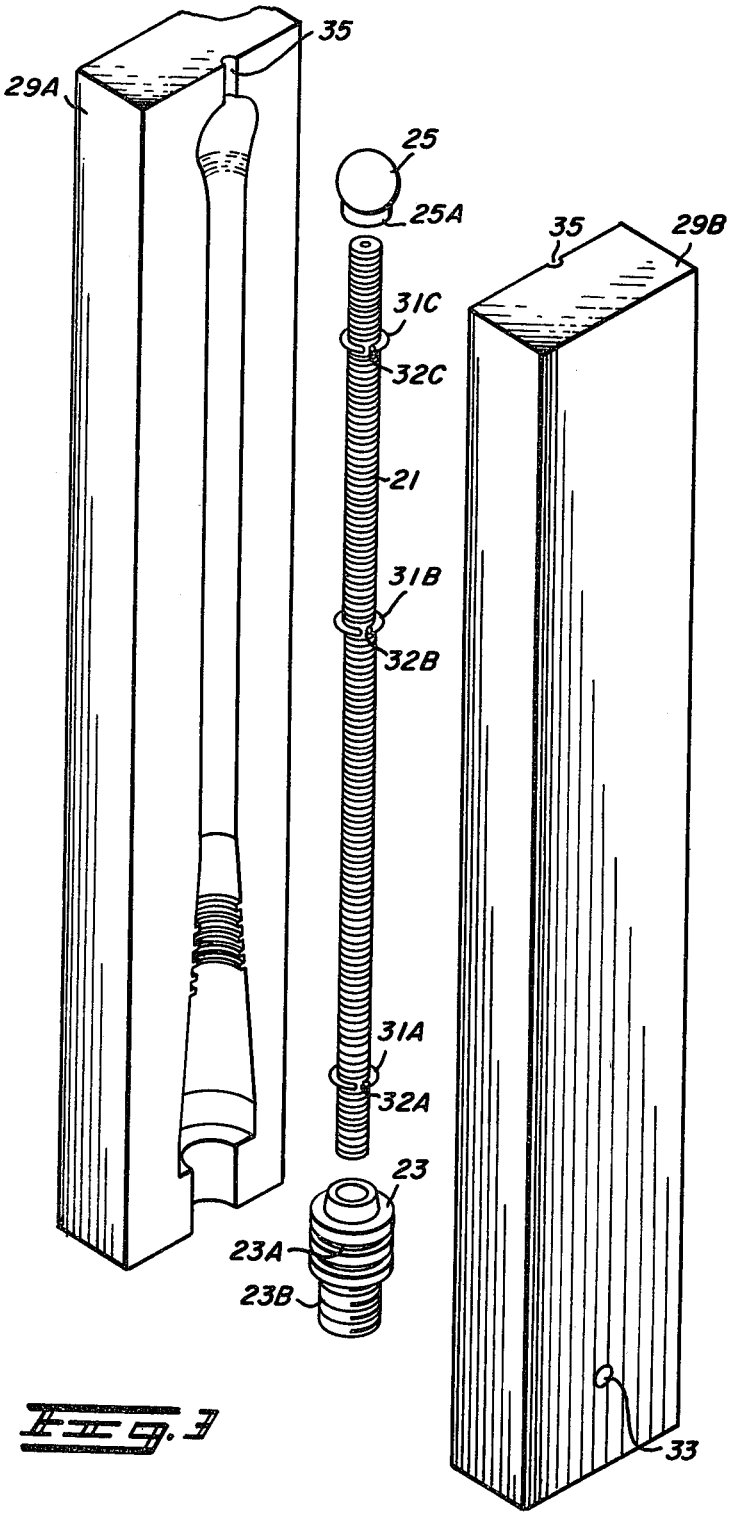
FIG. 3 is an exploded view of the antenna construction according to the invention together with representations of the mold forms used to form the protective cover of the invention.

FIG. 3 is an exploded view of the antenna subassembly of antenna cable 21, base section 23 and protection knob 25 with mold sections 29A and 29B used to form environmental cover 15 by an injection molding process. A molten plastic, preferably polyurethane, is injection molded into the closed mold sections 29A and 29B which surround the antenna subassembly of antenna cable 21, base section 23 and protection knob 25. There is a need to center the antenna subassembly within the mold sections 29A and 29B so that the polyurethane material molds to form a cover of equal thickness around the antenna cable 21. To provide for this, donut rings 31*a*, 31*b* and 31*c* are placed over the antenna cable 21 prior to the injection molding of the enviromental cover 15. The donut rings 31*a*, 31*b*, and 31*c* are preferably made of a soft plastic and shaped substantial like a round washer except the ring is cut through at a point 32*a*, 32*b* and 31*c*, so that the donut rings 31*a*, 31*b* and 31*c* can be opened and placed around the antenna cable 21. The donut rings have an outer diameter which is slightly less than the diameter of the smallest cross section of the cavity formed by closed mold sections 29A and 29B. The diameter of the hole in donut rings 31*a*, 31*b* and 31*c* are sufficient to allow the donut rings to easily slide along the length of antenna cable 21. Yet the hole diameter is less than the diameter of protection knob portion 25*a* shown in FIG. 3. A port 33 is provided as a means for injecting the molten polyurethane material into the closed mold sections 29A and 29B. An air vent hole 35 is provided at the top end of mold section 29A to allow the air inside the mold cavity a path to escape as the molten polyurethane is injected into the bottom end of the closed mold sections 29A and 29B.

In operation the mold sections 29A and 29B are closed over the antenna subassembly. The high viscosity molten polyurethane material which makes up the environmental cover 15 of the antenna 13 is injected into the port 33 in mold section 29A. The molten polyurethane is injected through port 33 at such an angle so as to create a circulating current about the center of the mold cavity. As more molten polyurethane is injected, the advancing circulating current causes the first donut ring 31*a* to be pushed along the length of the antenna cable 21 while polyurethane fills the mold cavity and surrounds the antenna subassembly. As the donut ring 31*a* progresses up the cable 21 it acts to center cable 21 while the polyurethane cover is being formed, thus an equal thickness of polyurethane material is deposited around antenna cable 21. Donut ring 31*a* meets with donut ring 31*b* at the approximate center of the mold cavity. Both rings continue to progress along the antenna cable 21 as the injected molten polyurethane pushes against donut ring 31*a*. At approximately three-quarters of the way up the antenna cable 21, donut rings 31*a* and 31*b* engage donut ring 31*c*. All three rings are pushed by the injected molten polyurethane toward the top of the antenna cable 21. The donut rings 31*a*, 31*b* and 31*c* reach the end of their travel at protection knob portion 25*a* since the hole diameter of the donut rings are less than the diameter of protection knob portion 25*a*. Continued injection of polyurethane causes the molten material to increase its pressure against the three donut rings resulting in the polyurethane flowing over the outer edges of the donut rings 31*a*, 31*b* and 31*c* since the ring outer diameter is less than the diameter of the mold cross-section. Thus the polyurethane material is able to cover the three donut rings and protection knob 25 thus completing the injection molding process. The antenna assembly is removed from the mold and allowed to cool and cure.

In summary, the invention provides an improved whip antenna construction while simultaneously providing a substantial reduction in construction costs.

We claim:

1. A whip antenna assembly for attachment to a receptacle in a communications device comprising:

a highly flexible conductive antenna cable having a first and second end, a conductive metal base section injection cast onto said antenna cable first end, a knob injection cast onto said cable second end, and an environmental cover injection molded over said antenna cable and base section to provide protection and support for said whip antenna assembly without substantially reducing the flexibility of said assembly.

2. A whip antenna assembly according to claim 1, wherein said knob has a spherical shape and said metal base section has a threaded portion to engage said receptacle.

3. A whip antenna assembly for attachment to a receptacle in a communications device comprising;

wire wound in a helix to form a highly flexible cable construction having a first and second end, a conductive metal base section injection cast onto said cable first end and having a threaded portion to engage the receptacle;

an environmental cover injection molded over said cable and base piece to provide protection and support for said whip antenna assembly without substantially reducing the flexibility of said assembly, wherein said environmental cover includes a skirt portion proximate to said threaded portion, said skirt portion acting as a gasket to seal and frictionally secure said whip antenna assembly when said threaded portion fully engages said receptacle.

4. A whip antenna assembly according to claim 3, wherein said environmental cover includes both finger grip flutes on the surface of said skirt portion and strain relief grooves immediately adjacent to said finger grip flutes.

* * * * *